United States Patent [19]

Delaney

[11] Patent Number: 4,488,313

[45] Date of Patent: Dec. 18, 1984

[54] SKI GLOVE

[76] Inventor: Richard D. Delaney, 12 Parkview Dr., Conneaut, Ohio 44030

[21] Appl. No.: 403,568

[22] Filed: Jul. 30, 1982

[51] Int. Cl.[3] ..... A41D 13/18

[52] U.S. Cl. ..... 2/17; 2/161 A

[58] Field of Search ..... 2/16, 17, 158, 161 R, 2/161 A

[56] References Cited

U.S. PATENT DOCUMENTS 4,213,205 7/1980 Smith ..... 2/161 A

FOREIGN PATENT DOCUMENTS 250978 9/1911 Fed. Rep. of Germany ..... 2/17
1956533 11/1969 Fed. Rep. of Germany ..... 2/17
154151 4/1932 Switzerland ..... 2/17
178402 7/1935 Switzerland ..... 2/17
154485 2/1920 United Kingdom ..... 2/158

*Primary Examiner*—Werner H. Schroeder
*Assistant Examiner*—Tracy Graveline
*Attorney, Agent, or Firm*—Charles L. Lovercheck; Wayne L. Lovercheck; Dale R. Lovercheck

[57] ABSTRACT

A ski pole attachment made up of a hand receiving member of heat insulation material having an open and a closed end. The ski pole grip can extend into the open end or into an opening in the side of the end receiving member and the ski pole may be held in place in the hand receiving member by means of a strap extending through two slots in the hand receiving member or it can be received in a tubular member extending up into the end receiving member. The operator can place his hand in the hand receiving member with or without a glove on his hand and can grasp the grip on the ski pole thereby holding the grip with his hand inside the hand receiving member.

5 Claims, 5 Drawing Figures

SKI GLOVE

GENERAL STATEMENT OF THE INVENTION

I have conceived, designed, developed and field tested an insulated enclosure that forms a sheath around the grip of a ski pole, then folds back from the base of the grip to envelope completely a hand gripping the pole. The models tested contained a layer of insulation one inch thick and a lining of one-half inch pile fabric around the hand. The pile fabric envelops the pole to become the grip sheath, providing insulation between the pole and hand.

The models were tested by several people on several occasions while skiing for extended periods of time in ambient temperatures of 5° F. to 30° F. All testers, without exception, decided the hand insulators were totally effective in keeping their hands and fingers warm under conditions where they would have been chilled with conventional protective gear.

A problem was encountered early in the development of the hand insulators pertaining to the insertion of hands into the gloves. It was soon learned that when one hand is completely enclosed it no longer can help the other hand into its glove. The problem was solved in the design of the cuff. Tight fitting cuffs made with elastic materials or straps and buckles could not pass the test of easy hand insertion. A cuff made of thick but pliant material that yields to pressure during hand insertion, but exerts enough reflex pressure to grasp the wrist lightly, worked well if the inside diameter was optimum.

We found with our gloves that the traditional tether straps of ski poles were not needed. The length and grasp of the thick cuffs, together with external elastic bands provided enough constraint to hold our hands within the gloves, even when the poles were gripped lightly or completely released. The retainer bands encircle the gloves, providing a coupling action between hand and pole. A final contributing factor to good hand-to-pole linkage is the acute angle of the cuff to the grip sheath. The angle applies a spring like tension which serves to hold the hand in the glove.

The accompanying drawings illustrate the construction and design features of our hand insulator.

REFERENCE TO PRIOR ART

Applicant is aware of U.S. Pat. Nos. 2,132,570 and 2,997,042. Neither of these Patents disclose a hand insulator having the features described above.

OBJECTS OF THE INVENTION

It is an object of the invention to provide an improved hand protecting device for use with a ski pole.

Another object of the invention is to provide an improved combination hand protecting device and ski pole.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
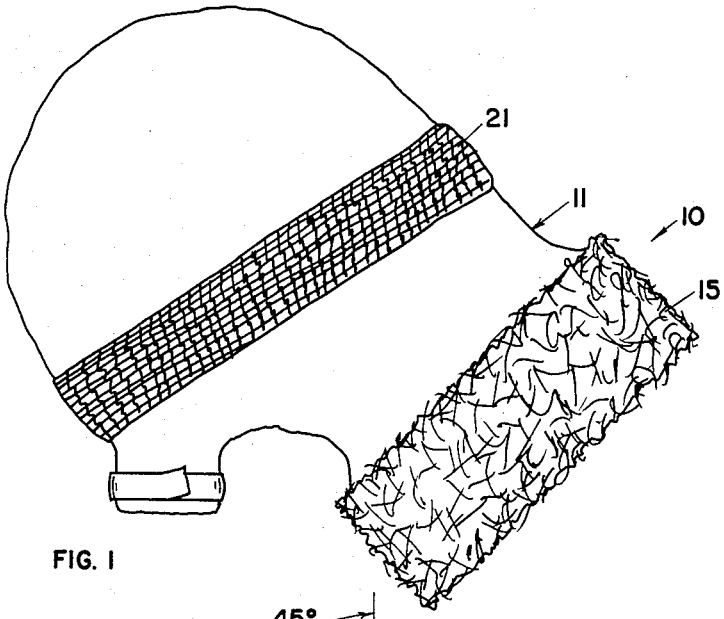
FIG. 1 is a side view of a hand receiving device on a ski pole in accordance with the invention.
Figure 2:
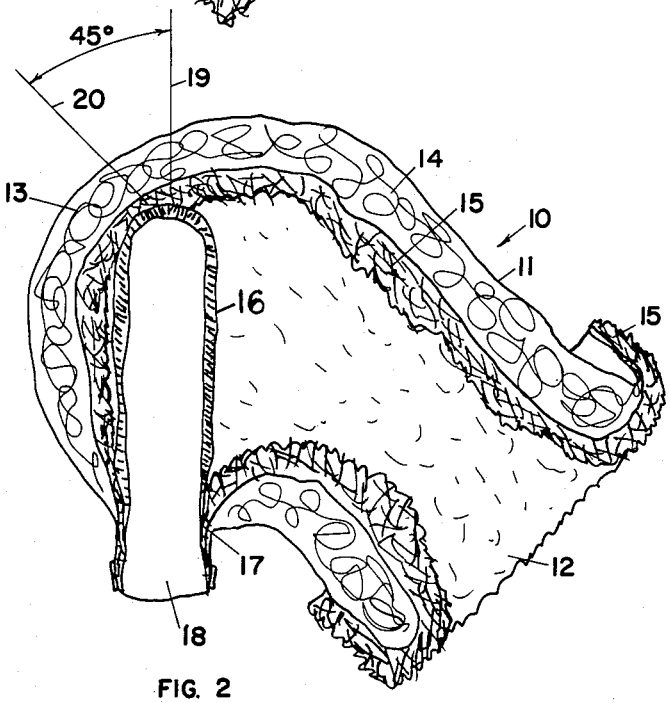
FIG. 2 is a longitudinal cross sectional view of the device shown in FIG. 1.

Now with more particular reference to the drawings, I show hand receiving member and ski pole receiving member 10 having a hand receiving member 11 having an open end 12 and a closed end 13. The hand receiving member is made of heat insulation material such as for example quilted down, foam plastic material or other suitable material indicated at 14. The hand receiving member may be lined by means of a suitable lining material 15 of a type familiar to those skilled in the art. A ski pole grip is inserted into the pocket 16 which extends through an opening in the side of the hand receiving member and is attached thereto at 17. The ski pole receiving member has an opening 18 through which the hand grip of a ski pole may be inserted.

The pocket 16 is a generally cylindrical member of sufficient diameter to receive the grip of the ski pole to be used and has an axis 19 which is disposed at an acute angle to the central axis 20 of the hand receiving member. The angle between the axis 19 and the axis 20 cn be in the order of 45° or less.

The cuff 15 can be made of an elastic material so that a hand can be easily inserted. The user may use the device disclosed herein either with or without an ordinary glove. By manipulating the glove, he will introduce the ski pole into the hand receiving member and grasp the pocket 16 with the ski pole grip in it.

The band 21 may be made of elastic material and assists in holding the hand receiving member firmly to the hand of the skier.

Figure 3:
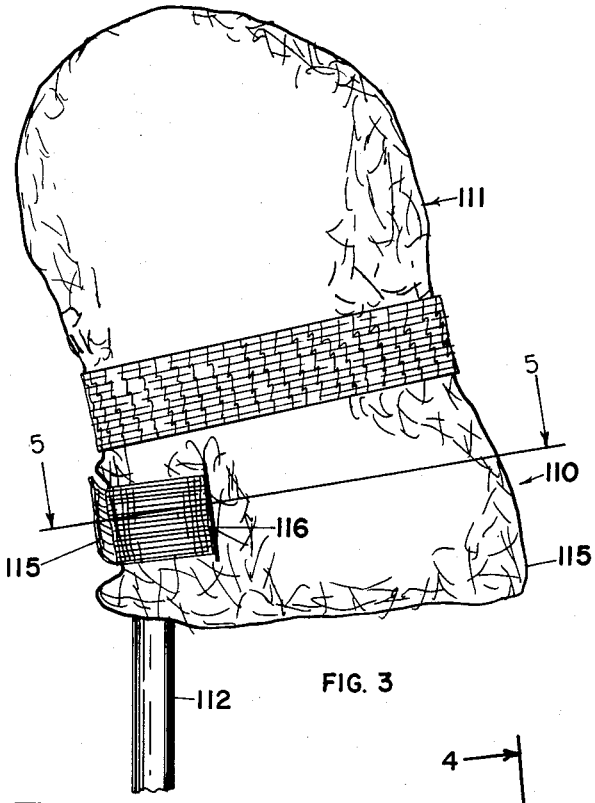
FIG. 3 is a side view of another embodiment of the invention.
Figure 4:
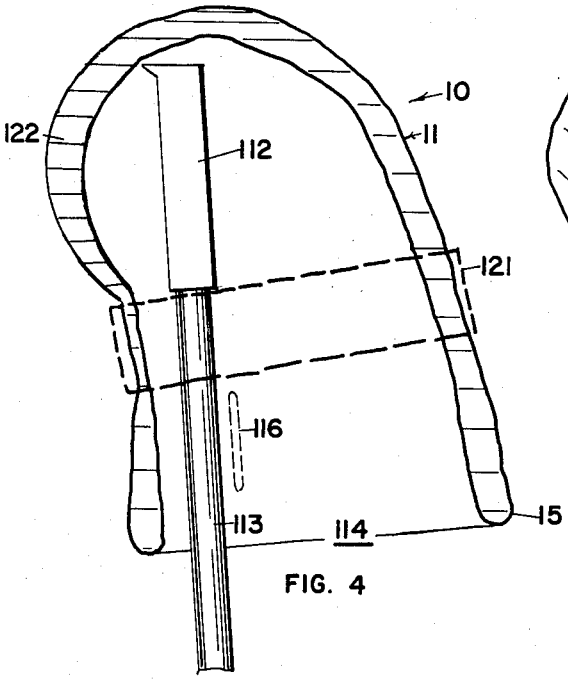
FIG. 4 is a cross sectional view taken on line 4—4 of FIG. 5.
Figure 5:
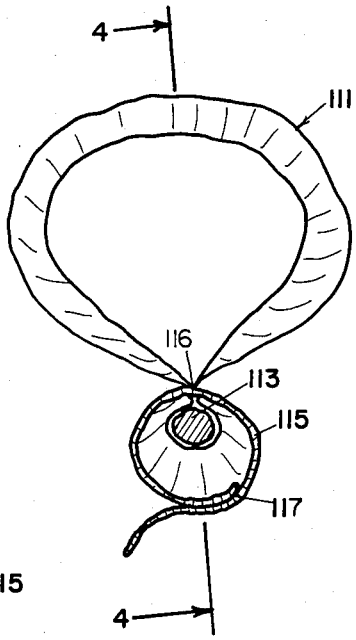
FIG. 5 is a cross sectional view taken on line 5—5 of FIG. 3.

In the embodiment of the invention shown in FIGS. 3, 4 and 5, I show a combination ski pole and hand receiving member 110 having a hand receiving member 111 that receives the ski pole grip 112 that is supported on the ski pole 113. The ski pole extends through the open end 114 of the hand receiving member and is encircled by the strap 115 which extends through the slots 116 in the hand receiving member and is fastened at 117. The fastening for the strap 115 may be a VELCRO material or other suitable fastener.

In operation the ski pole 113 will have its grip passed into the open end 114 of the hand receiving member and the strap 115 will be inserted through the slots 116 and fastened by means of the VELCRO 117. The operator may then insert his gloved hand or bare hand into the hand receiving opening 114 and grasp the grip 112 of the ski pole. The band 121 will be elastic and will hold the grip firmly to the operator's hand.

Since the ski pole is enclosed in the hand receiving member and rests along one side of it, the operator will not have his hand fatigued or cold. It will be noted that the hand receiving member 111 tapers or has a bulge 122 on the side adjacent the strap 115 so that the operator's hand and the ski pole grip will have a convenient location to be grasped by the hand of the skier.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A ski pole attachment comprising, a hand cover, said hand cover comprising a hand receiving member having an open end and a closed end, a ski pole, said ski pole extending through said open end of said hand receiving member, means to support said ski pole in said hand receiving member, said hand receiving member being adapted to have the hand of a skier extend through said open end and to grasp a grip on the ski pole with the ski pole and arm of said skier extending from said open end, and slots are formed in a side of said hand receiving member adjacent said ski pole and a strap extends through said slots and around said ski pole holding said ski pole in position.

2. The combination recited in claim 1 wherein a second strap is disposed around said hand receiving member in a position intermediate between said open end and said closed end for holding said hand receiving member on the hand of a skier.

3. The combination recited in claim 2 wherein said second strap is elastic.

4. The combination recited in claim 3 wherein said hand receiving member is generally in the form of a sleeve having a closed end and an open end and said closed end is bulged at one side for receiving the fingers of a user with said ski pole grip grasped therein.

5. The combination recited in claim 3 wherein said hand receiving member is adapted to have said ski pole grip lie along one side thereof with the fingers of a skier grasping said grip.

* * * * *